US007351015B2

(12) United States Patent
Price et al.

(10) Patent No.: US 7,351,015 B2
(45) Date of Patent: Apr. 1, 2008

(54) INVERTIBLE RETAINING WALL BLOCK

(75) Inventors: Brian A. Price, Rochester, MN (US); Raymond R. Price, Rochester, MN (US); Gerald P. Price, Rochester, MN (US)

(73) Assignee: Mortarless Technologies, LLC, Rochester, MN (US)

( * ) Notice: Subject to any disclaimer, the term of this patent is extended or adjusted under 35 U.S.C. 154(b) by 0 days.

(21) Appl. No.: 11/400,923

(22) Filed: Apr. 10, 2006

(65) Prior Publication Data

US 2007/0094991 A1 May 3, 2007

Related U.S. Application Data

(63) Continuation-in-part of application No. 29/240,236, filed on Oct. 11, 2005, now Pat. No. Des. 547,881, and a continuation-in-part of application No. 29/240,237, filed on Oct. 11, 2005, now Pat. No. Des. 548,365, and a continuation-in-part of application No. 29/240,278, filed on Oct. 11, 2005, now Pat. No. Des. 546,972, and a continuation-in-part of application No. 29/240,296, filed on Oct. 11, 2005, now Pat. No. Des. 555,808.

(51) Int. Cl.
*E04C 1/00* (2006.01)
*E02D 17/20* (2006.01)

(52) U.S. Cl. ..... 405/286; 52/603; 52/604; 52/605

(58) Field of Classification Search ..... 405/284–286; 52/603–605
See application file for complete search history.

(56) References Cited

U.S. PATENT DOCUMENTS

| | | | |
|---|---|---|---|
| 751,346 | A | 2/1904 | Schall |
| 1,526,730 | A | 2/1925 | Zottoli |
| 1,727,362 | A | 9/1929 | Bone |
| 4,123,881 | A | 11/1978 | Muse |
| 4,470,728 | A | 9/1984 | Broadbent |
| 4,592,678 | A | 6/1986 | McNinch, Jr. et al. |
| 4,802,320 | A | 2/1989 | Forsberg |
| 4,909,010 | A | 3/1990 | Gravier |

(Continued)

FOREIGN PATENT DOCUMENTS

| | | |
|---|---|---|
| JP | 54107105 | 8/1979 |

(Continued)

OTHER PUBLICATIONS

KeySystem 1, Retaining Wall System Brochure; Copyrighted 2000; pp. 1-8.

(Continued)

*Primary Examiner*—Tara L. Mayo
(74) *Attorney, Agent, or Firm*—Patterson, Thuente, Skaar & Christensen, P.A.

(57) ABSTRACT

An invertible retaining wall block comprises a front portion, a rear portion and a neck portion connecting the front portion and rear portion. A projection extends outwardly from the block to interlock with similar blocks in adjacent courses of blocks. One or more notches are provided to the front portion in order to allow the base course of blocks to be placed in an inverted orientation with respect to subsequent courses because the notch provides clearance for the protrusion.

14 Claims, 13 Drawing Sheets

U.S. PATENT DOCUMENTS

| | | | | |
|---|---|---|---|---|
| 4,914,876 | A | | 4/1990 | Forsberg |
| 4,920,712 | A | | 5/1990 | Dean, Jr. |
| D317,048 | S | | 5/1991 | Forsberg |
| 5,044,834 | A | | 9/1991 | Janopaul, Jr. |
| 5,064,313 | A | | 11/1991 | Risi et al. |
| 5,145,288 | A | | 9/1992 | Borcherdt |
| 5,163,261 | A | | 11/1992 | O'Neill |
| 5,337,527 | A | | 8/1994 | Wagenaar |
| 5,474,405 | A | | 12/1995 | Anderson et al. |
| 5,484,235 | A | | 1/1996 | Hilfiker et al. |
| 5,490,363 | A | | 2/1996 | Woolford |
| 5,505,034 | A | | 4/1996 | Dueck |
| 5,511,910 | A | | 4/1996 | Scales |
| 5,540,525 | A | | 7/1996 | Miller et al. |
| 5,551,809 | A | | 9/1996 | Forsberg |
| 5,653,558 | A | | 8/1997 | Price |
| 5,673,530 | A | | 10/1997 | Bailey, II |
| 5,704,183 | A | | 1/1998 | Woolford |
| 5,709,062 | A | | 1/1998 | Woolford |
| 5,711,129 | A | | 1/1998 | Woolford |
| 5,795,105 | A | | 8/1998 | Guth |
| 5,823,709 | A | | 10/1998 | Maher et al. |
| 5,827,015 | A | | 10/1998 | Woolford et al. |
| D405,543 | S | | 2/1999 | Shillingburg |
| 5,913,790 | A | | 6/1999 | Dawson |
| 6,019,550 | A | * | 2/2000 | Wrigley et al. ..... 405/262 |
| 6,113,318 | A | | 9/2000 | Guth |
| 6,168,353 | B1 | | 1/2001 | Price |
| 6,168,354 | B1 | | 1/2001 | Martin et al. |
| RE37,278 | E | | 7/2001 | Forsberg |
| 6,336,773 | B1 | | 1/2002 | Anderson et al. |
| D459,487 | S | | 6/2002 | Bott |
| 6,474,036 | B2 | | 11/2002 | Martin et al. |
| 6,536,994 | B2 | | 3/2003 | Race |
| 6,622,445 | B1 | | 9/2003 | Shillingburg et al. |
| 6,641,334 | B2 | | 11/2003 | Woolford |
| 6,651,401 | B2 | | 11/2003 | Price et al. |
| 6,652,197 | B2 | | 11/2003 | Shaw |
| 6,701,687 | B1 | | 3/2004 | Shillingburg |
| 6,792,731 | B2 | | 9/2004 | Bott et al. |
| D497,399 | S | | 10/2004 | May et al. |
| D501,935 | S | | 2/2005 | Dawson et al. |
| D508,739 | S | | 8/2005 | Shillingburg |
| D509,911 | S | | 9/2005 | Shillingburg |
| 7,096,635 | B2 | | 8/2006 | Price et al. |
| D530,832 | S | | 10/2006 | Rainey |
| 2005/0016106 | A1 | | 1/2005 | Dawson et al. |

FOREIGN PATENT DOCUMENTS

| | | |
|---|---|---|
| JP | 54107106 | 8/1979 |
| JP | 59-167842 | 11/1984 |

OTHER PUBLICATIONS

Case Study, Water Application, Keystone Retaining Wall System; Upper Cumberland River Flood Project; Copyrighted 2000; pp. 1-4.
Case Study; Governmental Application; Keystone Retaining Wall System; Port of Seattle Terminal #5; S. W. harbor Reclamation; Copyrighted 2000; pp. 1-4.
Keystone; Retaining Wall System; The First To Last; Copyrighted 1997; pp. 1-20.
International Search Report, 2 pages.

* cited by examiner

INVERTIBLE RETAINING WALL BLOCK

REFERENCE TO RELATED APPLICATIONS

This application is a continuation-in-part of U.S. Design Patent Application No. 29/240,236, filed Oct. 11, 2005, now U.S. Pat. No. D,547,881 U.S. Design Patent Application No. 29/240,237, filed Oct. 11, 2005, now U.S. Pat. No. D,548,365 U.S. Design Patent Application No. 29/240,278, filed Oct. 11, 2005, now U.S. Pat. No. D,546,972 and U.S. Design Patent Application No. 29/240,296, filed Oct. 11, 2005, now U.S. Pat. No. D,555,808 all of which are hereby incorporated by reference herein in their entirety.

FIELD OF THE INVENTION

The present invention relates generally to stackable concrete blocks and more particularly to concrete blocks which may be stacked with a base course in an inverted configuration.

BACKGROUND OF THE INVENTION

Concrete blocks for free standing and retaining walls have been known and used for many years. They can be both functional and decorative, and range from small gardening applications to large-scale construction projects. Such walls are typically used to form horizontal surfaces or terraces by providing a generally vertical barrier behind which backfill may be deposited. Such walls reduce erosion and slumping and maximize land use.

Walls can be constructed from stackable concrete blocks. Blocks are stacked in horizontal rows called courses. Multiple successive courses may be used to create a vertically rising wall of a desired height. These types of blocks can generally be assembled quickly and economically due to the interlocking of adjacent courses of blocks. Typically, each block includes some type of interlocking system such as pins, lips or projections so that one course of blocks interlocks with an adjacent course of blocks to create a stable structure. These features are often located on the bottom surfaces of the blocks and project downward into an opening in a lower course of blocks because if the projections are on the top surface of the blocks the wall will require specially manufactured cap blocks. This, however, can cause problems with the first course of blocks because it is laid directly upon the base surface so there is no open area for the interlocking features to rest in. In order to create a level base course, builders often have to excavate material from the base surface. This process often makes the base course the most difficult and time consuming course to build. Alternatively, blocks manufactured without projections can be used in the base course. This, however, requires having two different types of blocks on hand which increases the cost and complexity of stacking, manufacturing, storing, and palletizing the blocks.

SUMMARY OF THE INVENTION

The present invention addresses the need to provide for a block design that can form a base and subsequent courses without the need for separate base blocks or provision of relief in the base surface. Such invertible retaining wall block comprises a front portion, a rear portion and a neck portion connecting the front portion and rear portion. A projection extends outwardly from the block to interlock with similar blocks in adjacent courses of blocks. One or more notches are provided to the front portion in order to allow the base course of blocks to be placed in an inverted orientation with respect to subsequent courses because the notch provides clearance for the protrusion.

DETAILED DESCRIPTION

Referring to FIGS. 1-4 there can be seen an invertible retaining wall block 100 according to an embodiment of the present invention. Invertible block 100 generally comprises a head or front portion 102 and a tail or rear portion 104 connected by a transverse or neck portion 106.

Figure 13:
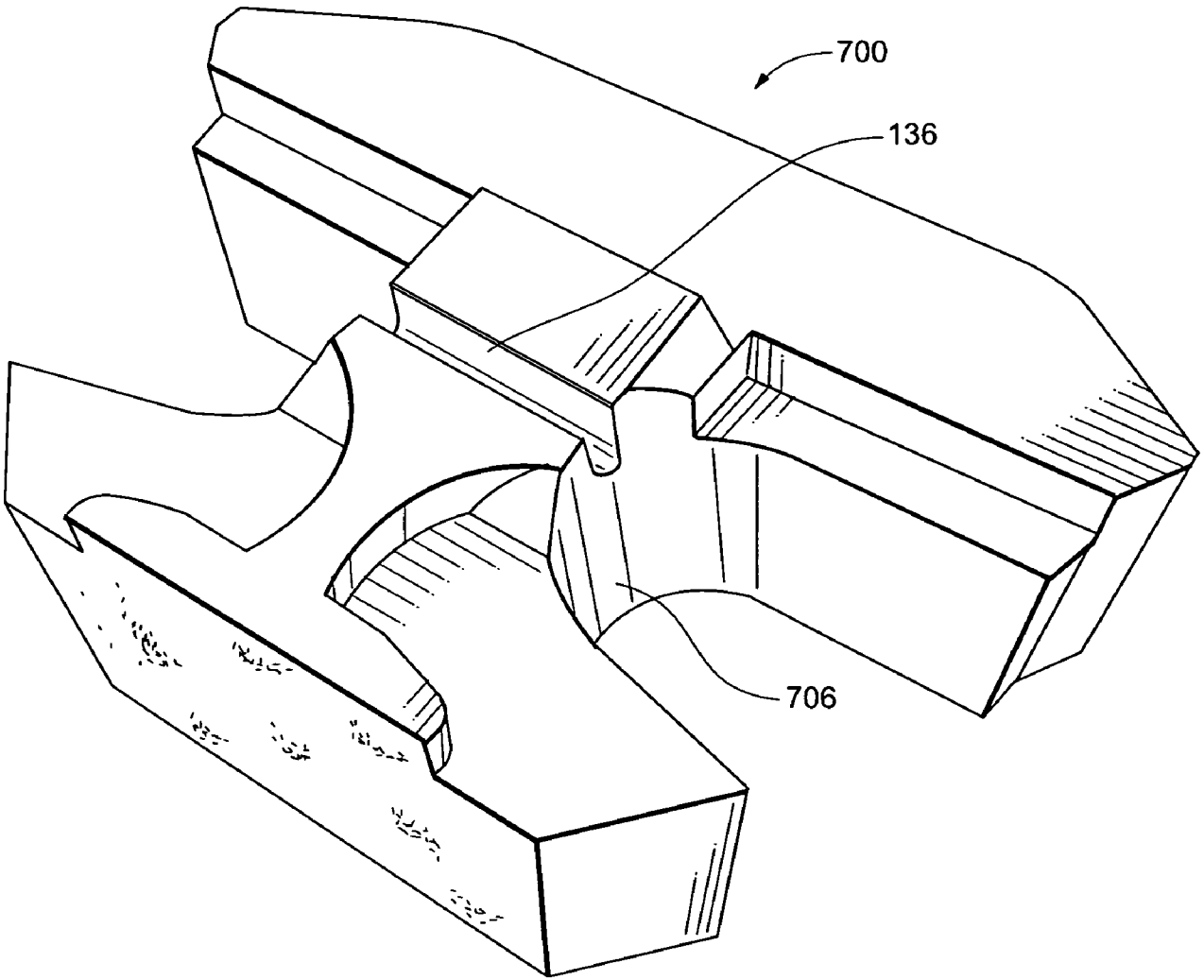
FIG. 13 is a perspective view of an invertible retaining wall block according to an embodiment of the present invention.

Front portion 102 comprises a front surface 108 and opposing rearwardly facing or rear-facing inner surface 110 on the rear side 111 of the front portion 102, a top surface 112 and opposing bottom surface 114 and opposing first 116 and second 118 side surfaces. Rear portion 104 comprises a rear surface 120 and opposing forward-facing inner surface 122, a top surface and 124 and opposing bottom 126 surface, and opposing first 125 and second 127 side surfaces. The neck portion 106 extends between the inner surfaces 110 and 122 of front portion 102 and rear portion 104 and includes a top surface 134 and opposing bottom surface 154 and first 138 and second 140 side surfaces. As shown in FIG. 13, neck portion 106 may optionally be provided with a slot 136 in which horizontal reinforcement may be placed, as is known in the art. The top surfaces 112, 124, and 134 of the front portion 102, rear portion 104, and neck portion 106 define a block top surface 142. The bottom surfaces of 114, 126, 154 of front portion, rear portion, and neck portion define a block bottom surface 144.

Front surface 108 of front portion 102 may be given a decorative appearance. Such decorative appearances include broken rock, stacked rocks, natural stone, brick, striated or roughened texture. Persons of skill in the art will recognize that the present invention is not limited to a specific decorative facial appearance unless specifically indicated in a given Claim. Alternatively, some or all of front surface 108 may be provided with a smooth appearance.

Invertible block 100 further includes a projection 121 extending outwardly from the block opposite of block top surface 142. Projection 121 comprises an interlocking portion 128 and a spacing portion 130. Interlocking portion 128 includes a front surface 146 and opposing rear surface 148, opposing first 150 and second 152 side surfaces, and an indexing surface 154. Indexing surface 154 may comprise some or all of the same surface as neck portion bottom surface. Side surfaces 150, 152 extend only partway along the length of top surface, until intersecting with side surfaces 138, 140 of neck portion. Front surface 146 of interlocking portion 128 is generally perpendicular in order to facilitate the interlocking of adjacent blocks. Rear surface 148 and side surfaces 150, 152 may be at an angle to make projection 121 easier to manufacture. Interlocking portion 128 may be generally rectangular, square, triangular, trapezoidal, or any other similar shape.

Spacing portion 130 extends outwardly from rear surface 148 of interlocking portion 128 and outwardly opposite of block top surface 142. Spacing portion 130 comprises a tail portion 129 and a tapered neck portion 131. A projection 121 formed of an integral interlocking portion 128 and spacing portion 130 increases the strength and chipping resistance of the projection 121. Although one specific spacing portion 130 configuration is depicted, one of skill in the art will recognize that spacing portion 130 may take on a variety of configurations, for example, neck portion 131 may not taper, linearly taper, taper in the opposite direction, or be eliminated. Spacing projection 130 has dual functions, one of which is to position the block when it is placed on a lower course of blocks that are arranged in a convex course, the other of which is to facilitate stacking on a pallet for shipping.

Invertible block 100 also includes first and second notched portions 132, 133 defined in front portion 102. Notched portions 132, 133 each include a stop surface 135 and extend inward from front portion inner surface 110 and downward from front portion bottom surface 114. Notched portions 132, 133 are located on each side of neck portion 106 and may extend laterally from front portion side surfaces 116 and 118 to interlocking portion side surfaces 150 and 152. The depth of notched portions 135 from bottom surface 114 of front portion 102 is preferably greater than, but at least equal to, the distance that interlocking portion 128 extends outward opposite of block top surface 142. Notched portions 132, 133 may define a curve, a right angle, or any other angle. As will be described more fully below, notched portions 132 allow invertible blocks 100 to be stacked with an inverted base course.

Figure 1:
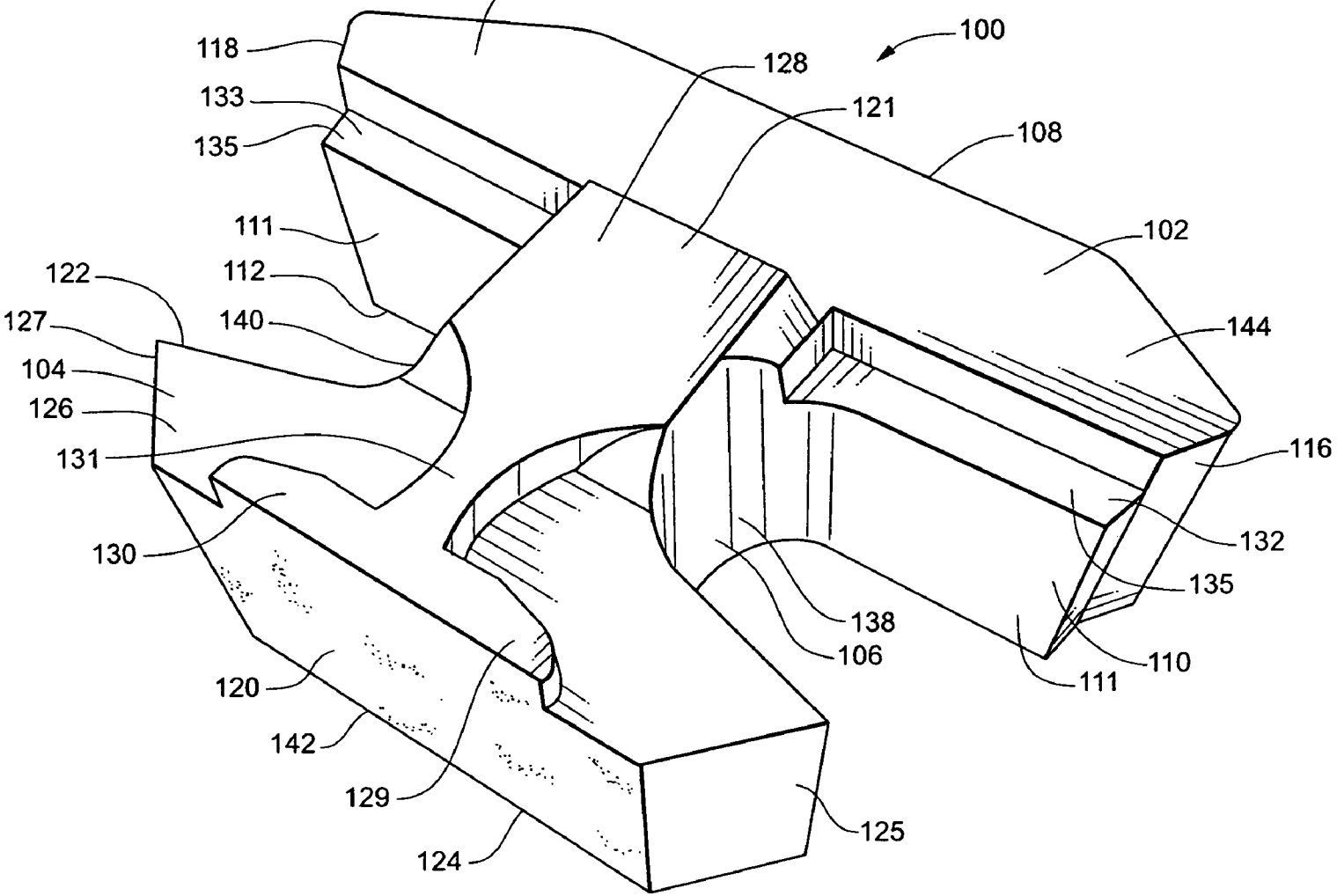
FIG. 1 is a perspective view showing the bottom of an invertible retaining wall block according to an embodiment of the present invention.
Figure 2:
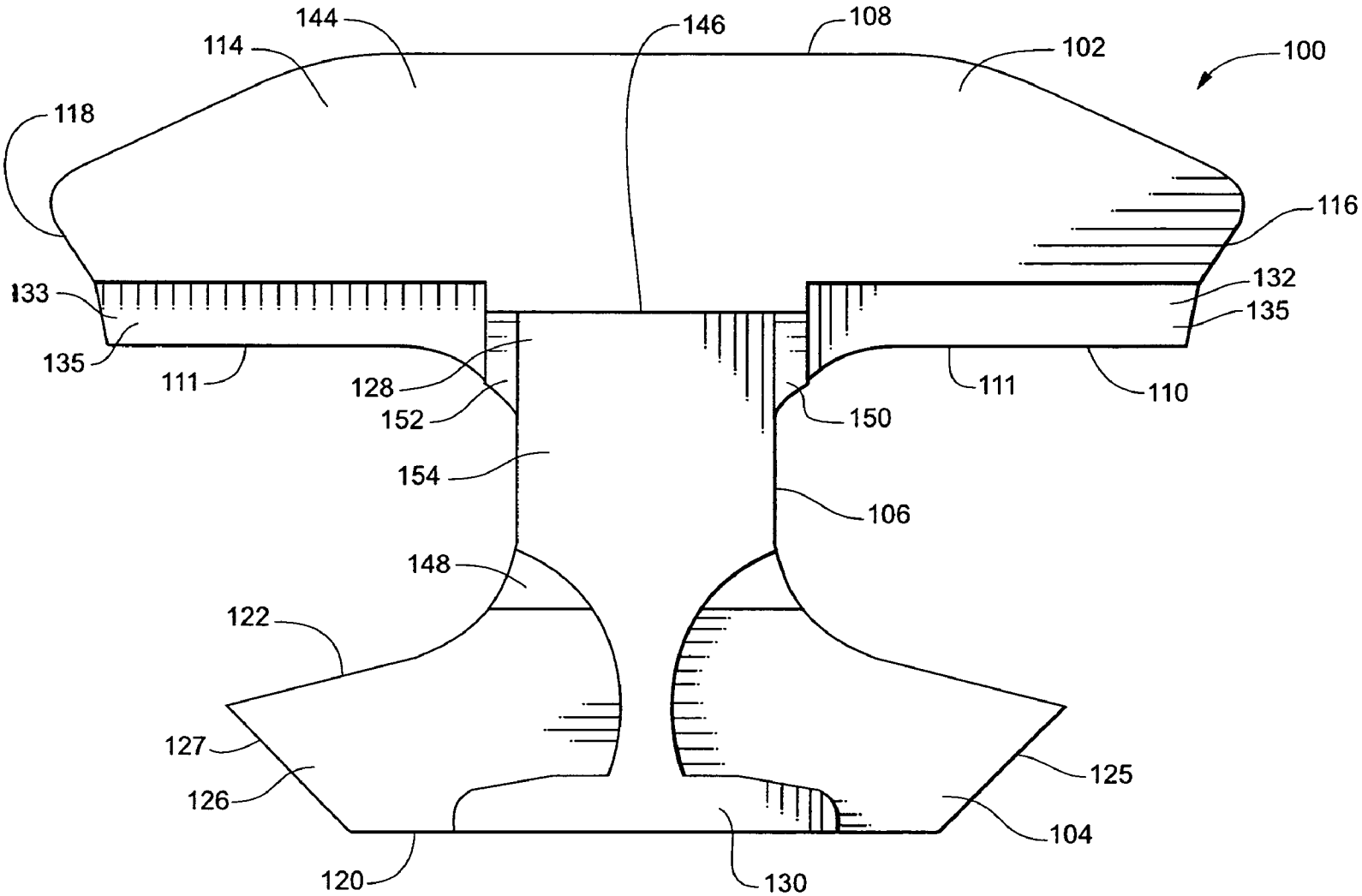
FIG. 2 is a bottom view of an invertible retaining wall block according to an embodiment of the present invention.
Figure 3:
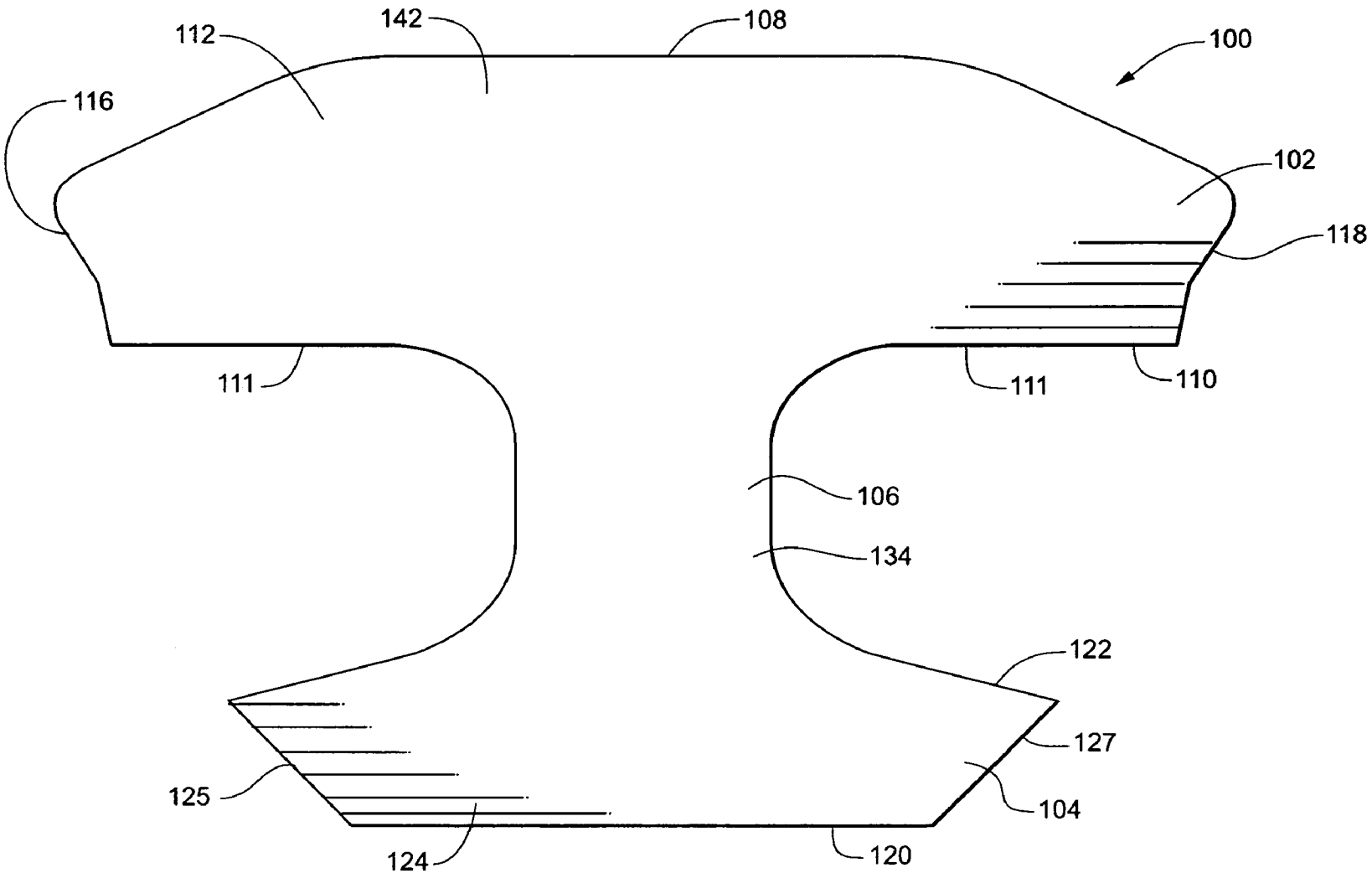
FIG. 3 is a top view of an invertible retaining wall block according to an embodiment of the present invention.
Figure 4:
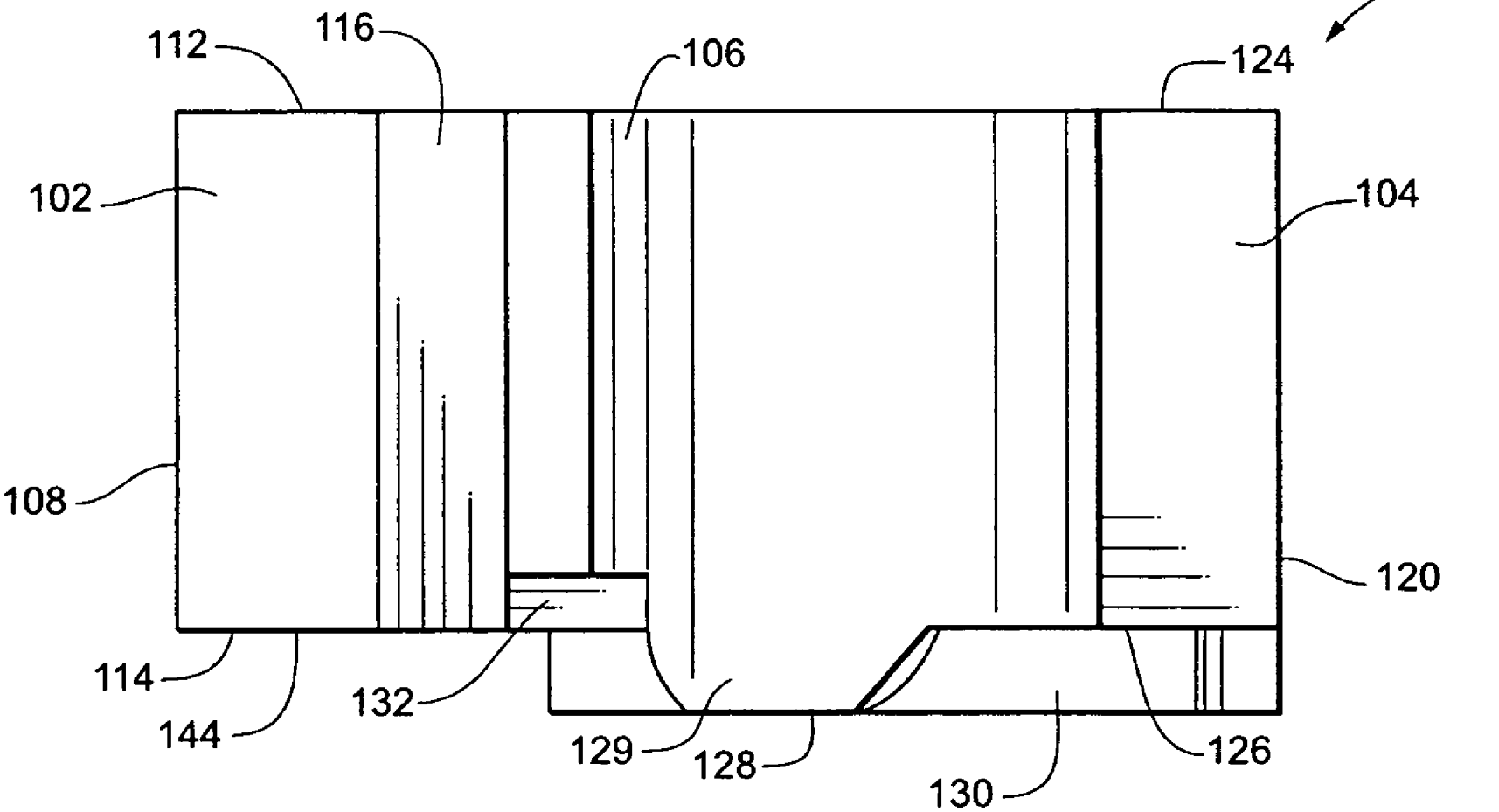
FIG. 4 is a side view of an invertible retaining wall block according to an embodiment of the present invention.
Figure 5:
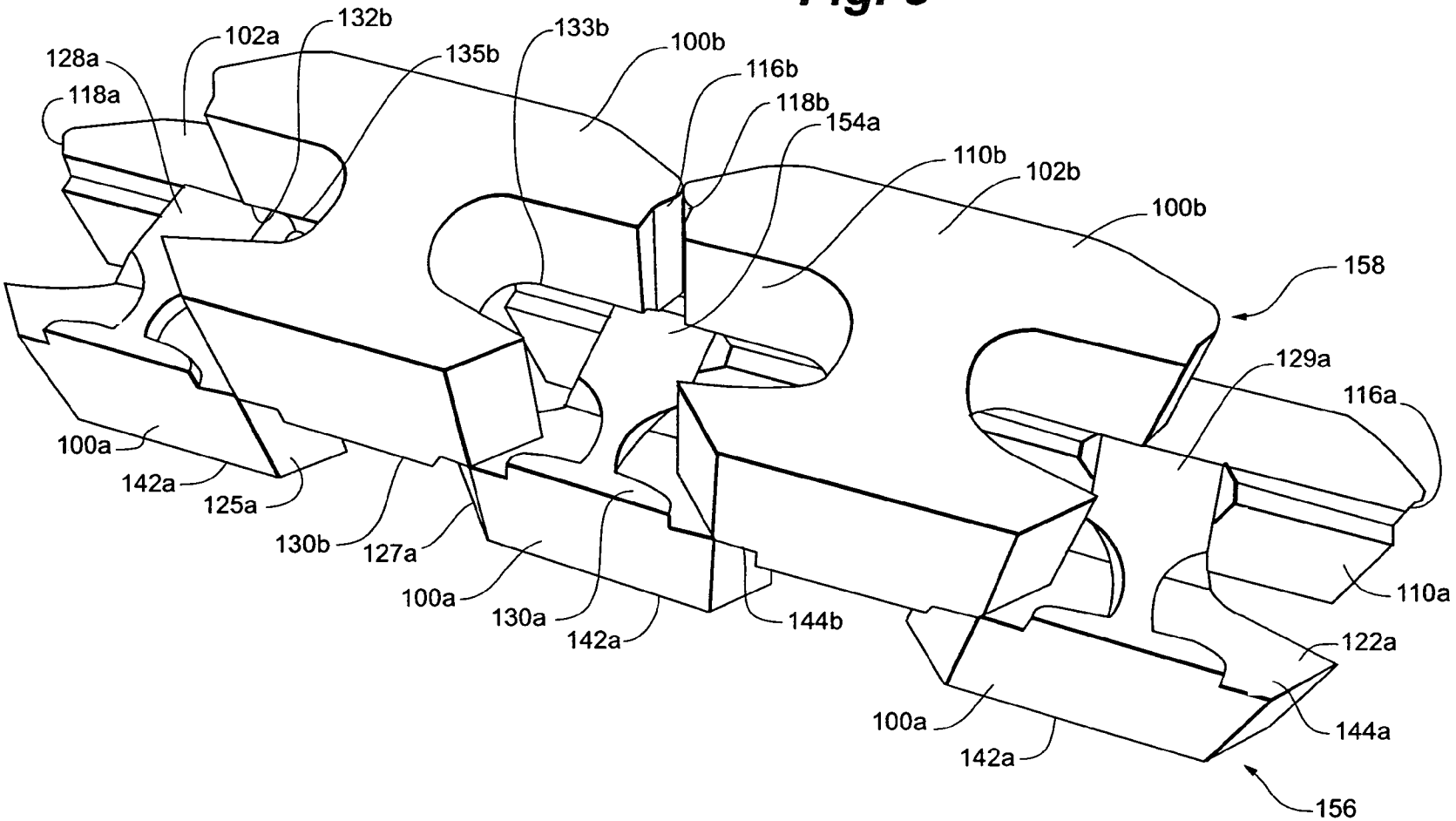
FIG. 5 is a perspective view of a plurality of invertible retaining wall blocks stacked in a wall segment according to an embodiment of the present invention.
Figure 6:
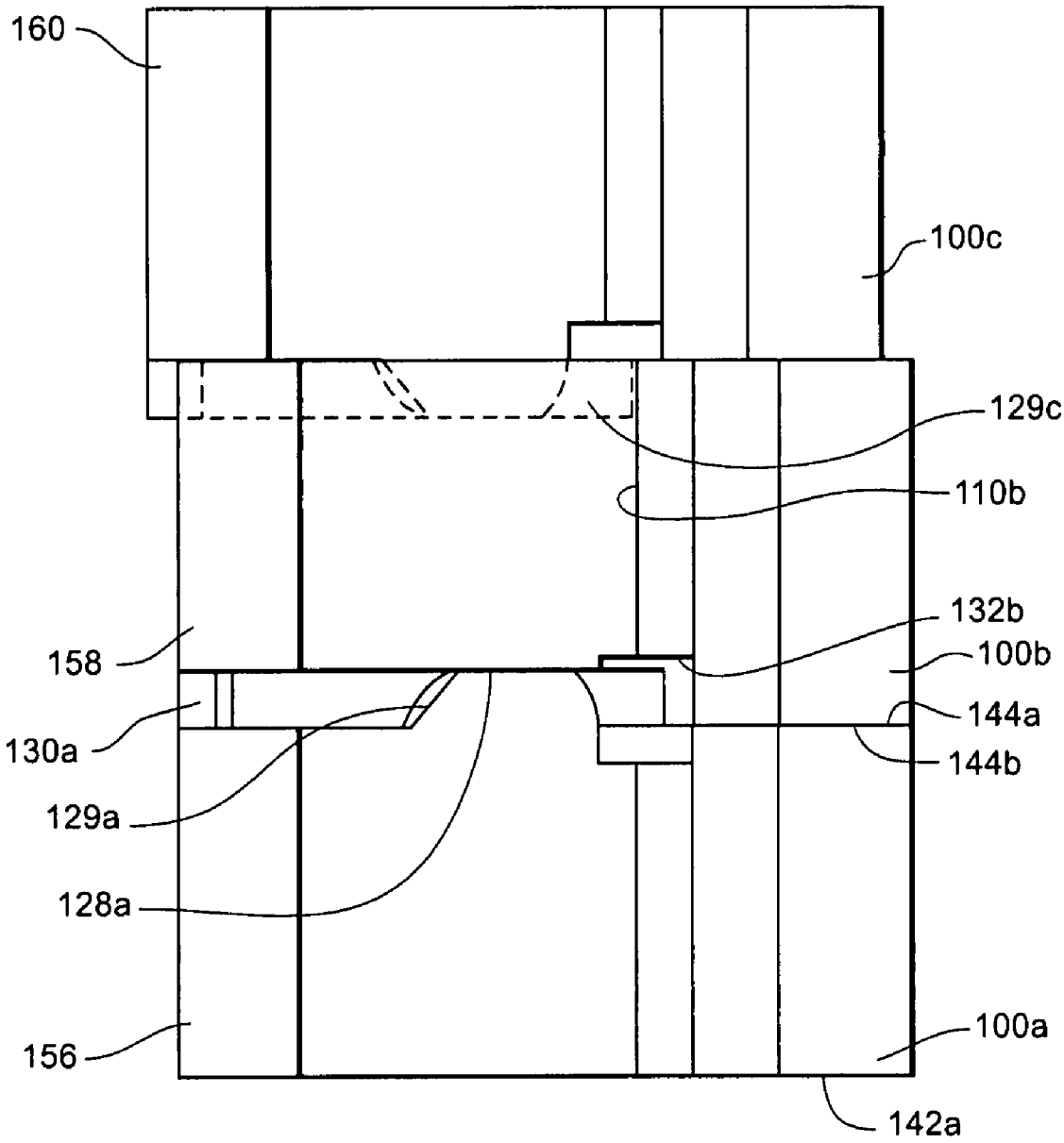
FIG. 6 is a side view of a plurality of invertible retaining wall blocks showing a stacking arrangement according to an embodiment of the present invention.

Referring now to FIGS. 5 and 6, there can be seen a plurality of invertible blocks 100 according to an embodiment of the present invention in a stacked configuration. Blocks in each course are laid such that the side surfaces 116 and 118 of the front portion 102 of each block 100 abut a side surface of the front portion of each adjacent block. When a course has been laid, fill material, such as rock or dirt, may be backfilled behind the blocks and into the space between the inner surfaces 110 and 122 of the front portion 102 and rear portion 104 to help stabilize the wall.

Blocks 100*a* in the base course 156 are laid upside down, with the top surface 142*a* of each base block 100*a* contacting the ground or other base surface. Consequently, the interlocking portion 128*a* and spacing portion 130*a* of each projection 129*a* of each base block 100*a* extend upwardly from each block 100*a*. It is therefore unnecessary to dig a recess in the base surface to create a level base course.

The second course 158 of blocks 100*b* is then placed on top of the first course 156 in the usual orientation, with the bottom surface 144 of the blocks facing downward. Each block 100*b* in the second course is centered above two base blocks 100*a*. Stop surfaces 135*b* of notched portions 132*b*, 133*b* of the blocks 100*b* in the second course 158 may rest upon the indexing surfaces 154*a* of interlocking portions 128*a* of projections 129*a* of base blocks 100*a*. In addition, indexing surfaces of interlocking portions of the blocks in the second course may rest upon stop surfaces of notched portions in base blocks. Because the depth of notched portions is greater than or equal to the height of interlocking portions, bottom surfaces of front and rear portions of the second course 158 rest flush against bottom surfaces of front and rear portions of first course 156. Spacing portions 130*b* in the second course 158 of blocks rest between rear portion side surfaces 125*a* and 127*a* of each pair of base blocks 100*a*.

When two courses of blocks are inverted and placed on each other, the outermost sections of the front portion 102*b* of each block 100*b* in the second course 158 are aligned with the interlocking portions 128*a* projecting outward from the top surface 102*a* of the blocks 100*a* in the first course 156, which would ordinarily cause the second course 158 to rest unevenly on the first course 156. However, the addition of notched portions 132*b*, 133*b* greater than or equal to the height of the interlocking portions 128*a* to receive the interlocking portions 128*a* allows the second course to rest flush on the first course. Notched portions in base blocks that are aligned with the portion of interlocking portions of the blocks in the second course that would otherwise rest upon bottom surface of base block front portions further prevent blocks from resting unevenly on each other. Blocks of this design therefore allow the base course 156 to be placed upside down, with the projections 129*a* projecting upwardly, which eliminates the need either to dig up a portion of the base surface to accommodate projections or to use a projectionless base course of blocks.

The third course 160 of blocks 100*c*, and subsequent courses, can then be added in the same orientation as the second course 158. Projections 129*c* of the blocks 100*c* in the third course 160 rest against the front portion inner surfaces 110*b* of the second course of blocks. This prevents forward movement of each new course of blocks and also creates a setback between adjacent courses.

In order for blocks to align properly such that a block in an overlying course rests between two blocks in an underlying course, block courses must be shifted by half of a block relative to one another. This is commonly referred to as a running bond. Accordingly, half-blocks having a notched portion can be utilized to provide this offset and, where necessary, to present a finished appearance to ends of walls where necessary. Such half-blocks as well as quarter-blocks, corner blocks, cap blocks and other block variations can be provided by slight variations to the basic block design, as is known in the art. Due to the generally planar nature of top surface of invertible blocks, conventional cap blocks having a flat bottom surface can be used.

Because rear portion 104 is narrower in width that front portion 102, blocks may be oriented at oblique angles to one another to create curved or serpentine walls. Due to this size difference, rear portions 104 of adjacent angled blocks do not interfere with one another even when blocks are angled towards one another.

Figure 7:
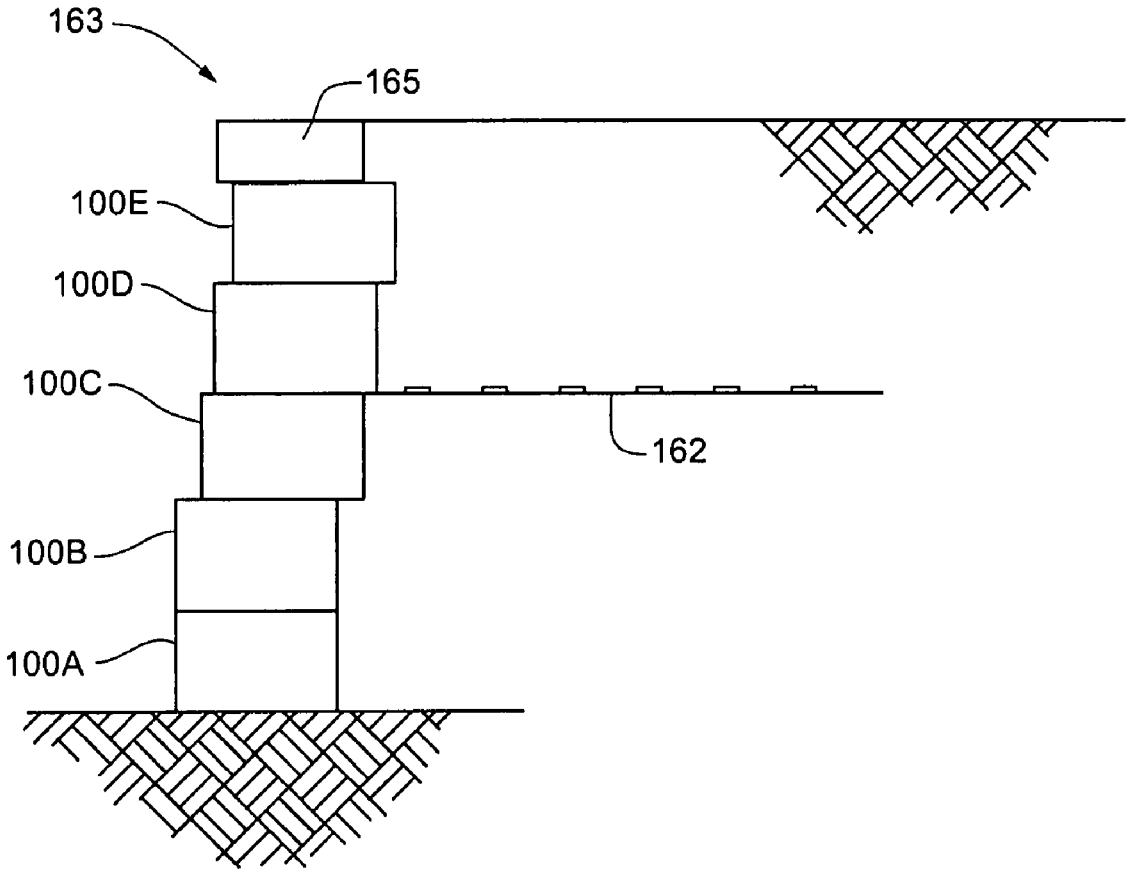
FIG. 7 is a side view of a plurality of invertible retaining wall blocks in stacked configuration in combination with an earth anchor according to an embodiment of the present invention.
Figure 8B:
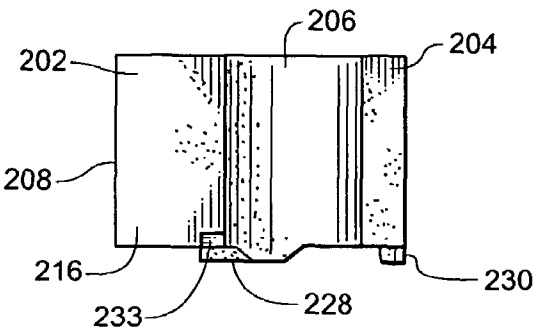
FIG. 8B is a side view.
Figure 8D:
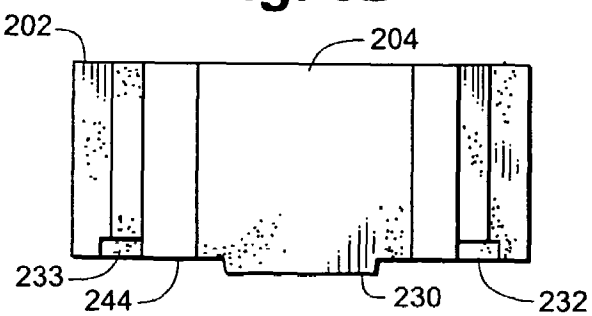
FIG. 8D is a rear view of an invertible retaining wall block according to an embodiment of the present invention.
Figure 8A:
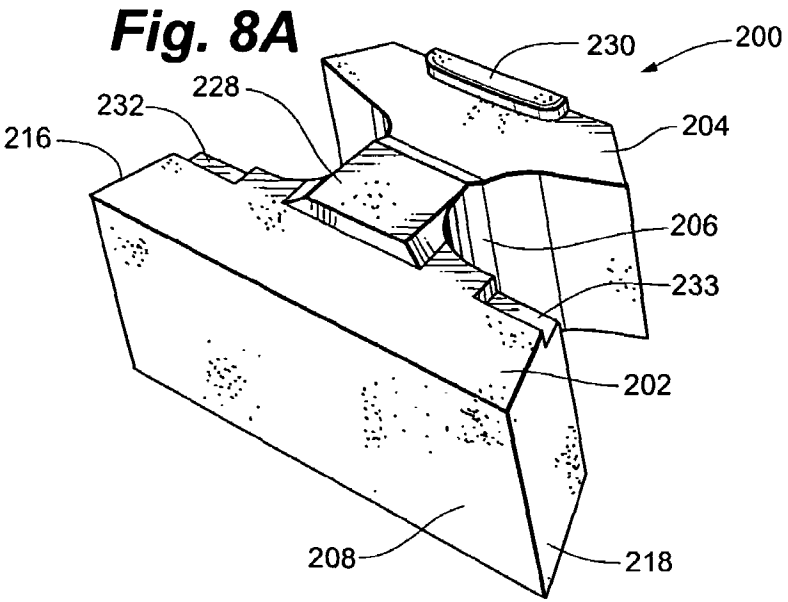
FIG. 8A is a bottom perspective view.
Figure 8C:
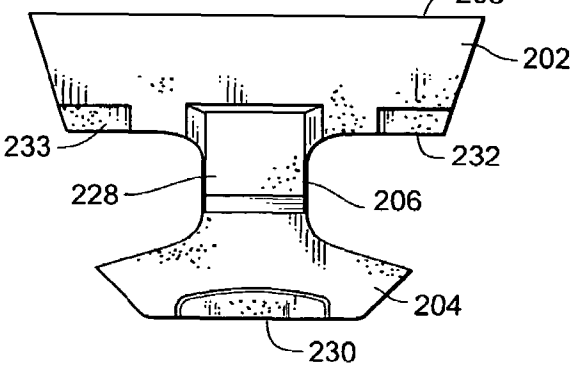
FIG. 8C is a bottom view.

A wall 163 formed of invertible blocks 100A-100E is shown in FIG. 7. Note that for simplicity of presentation, the detailed features 100A-100E of these blocks are not shown. Wall 163 may include a course of cap blocks 165 as the top course of the wall 163 to provide a finished appearance to the top of the wall. Wall 163 may also utilize an earth anchor 162. The present invention may be used with various types of earth anchors 162, such as such as metal grids or lattices and plastic grids or lattices such as geo-grid, which are known in the art and significantly improves the stability of a wall. An earth anchor 162 may be placed between courses of blocks 100 and extends back into the material behind the wall. Earth anchor 162 is held in place by the weight of the blocks and fill material, as is known in the art.

Blocks of the present invention are preferably made from a rugged, weather resistant material, such as zero-slump concrete, for high strength and durability in outdoor applications. However, blocks may be made of numerous other materials, for example, plastic, fiberglass, wood, metal, or stone. Blocks are most preferably manufactured in a high-speed application using the so called dry-cast manufacturing method known in the art. The material composition for such process generally comprises sand, aggregate, cement, fly ash and, optionally, selected admixtures. Persons having skill in the art of dry-cast concrete block manufacture understand that material mixtures can be varied to meet a variety of performance requirements.

Persons of skill in the art will recognize that by providing a block design that can be manufactured with at least one of a flat top or bottom surface, the manufacturing process can be performed more easily, quickly and inexpensively using dry-cast manufacturing methods, when compared to designs that do not have at least one of a flat top or bottom surface. These advantages are due, at least in part, to the fact that core pulling need not be performed to form relief in the block surface opposite the compression head.

Referring now to FIGS. 8A-8D, there can be seen an invertible block 200 according to another embodiment of the present invention. Invertible block 200 comprises a front portion 202 and a rear portion 204 connected by a neck portion 206 with an interlocking projection 228 extending from a bottom surface 244 of the block 200. FIGS. 8A-8D depict an alternative straight-faced, planar, front surface 208 of front portion 202, as opposed to the multi-faceted, beveled front surface 108 of invertible block 100. In addition, notched portions 232, 233 of invertible block 200 extend only partway from front portion side surfaces 216 and 218 towards interlocking projection 228. Courses of blocks having such notched portions 232, 233 can still be stacked in an inverted fashion because, as can be seen in FIG. 5, interlocking portions in the first course interfere with only the outermost sections of front portion of the second course. Notched portions, therefore, need only be large enough to accommodate the interfered with portion and need not span the entirety of the top surface of front portion. In addition, invertible block 200 includes a spacing projection 230 that is separate from interlocking projection 228. This makes invertible block 200 lighter and easier to handle than invertible block 100. Separate spacing projection 230 will also still serve its dual functions of positioning blocks when placed on a lower course of blocks that are arranged in a convex course and facilitating stacking on a pallet for shipping.

Figure 9B:
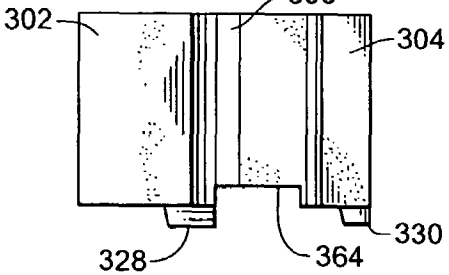
FIG. 9B is a side view.
Figure 9D:
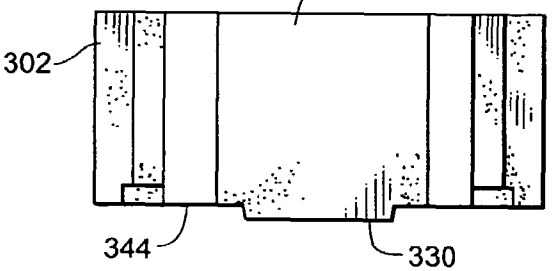
FIG. 9D is a rear view of a retaining wall block according to an embodiment of the present invention.
Figure 9A:
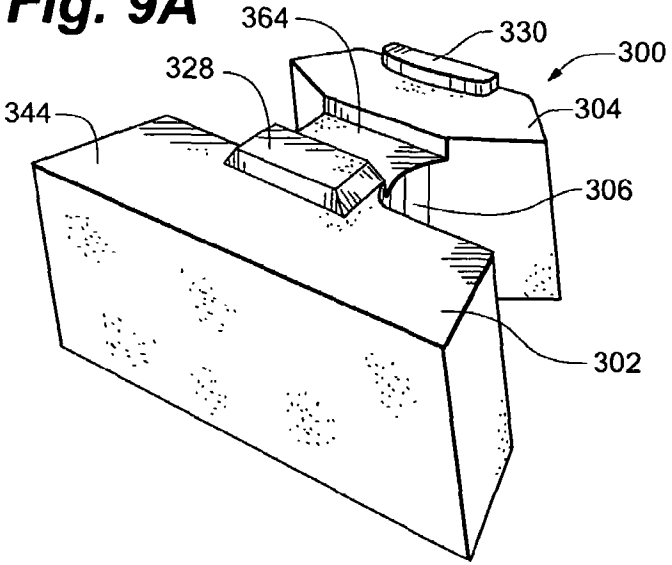
FIG. 9A is a bottom perspective view.
Figure 9C:
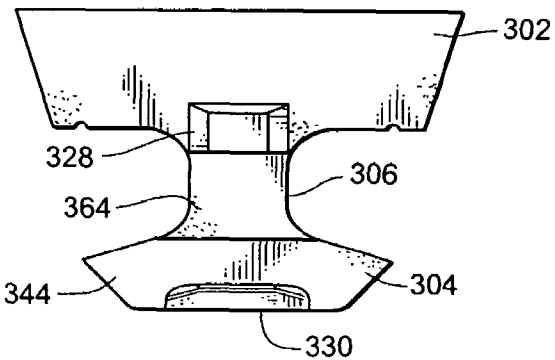
FIG. 9C is a bottom view.
Figure 10B:
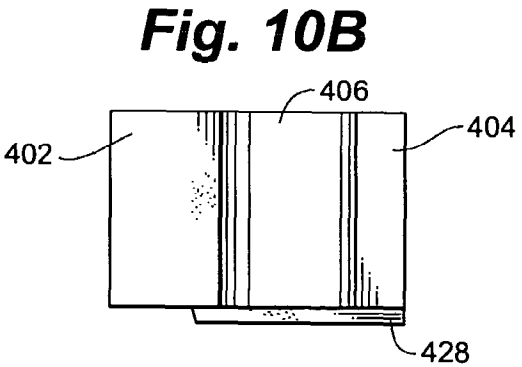
FIG. 10B is a side view.
Figure 10D:
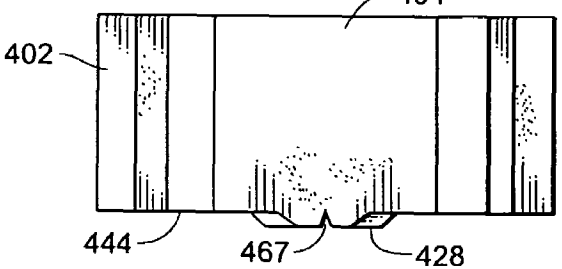
FIG. 10D is a rear view of a retaining wall block according to an embodiment of the present invention.
Figure 10A:
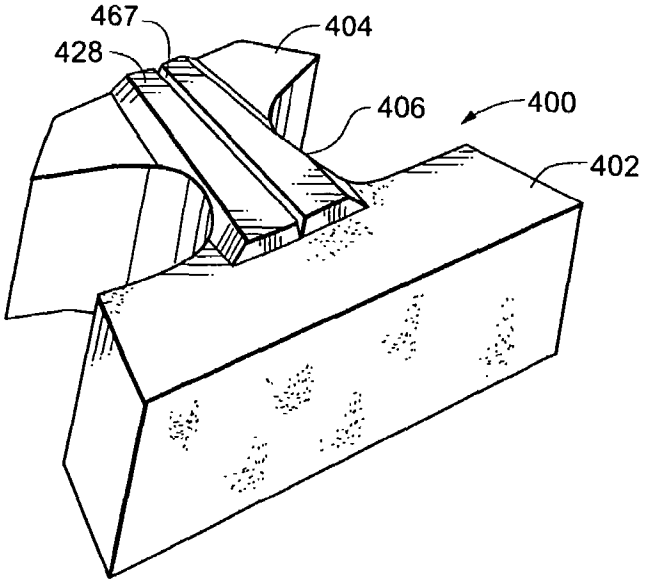
FIG. 10A is a bottom perspective view.
Figure 10C:
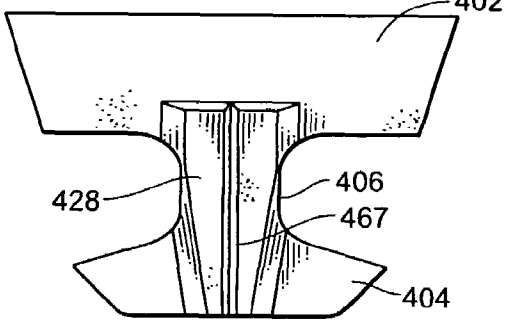
FIG. 10C is a bottom view.
Figure 11B:
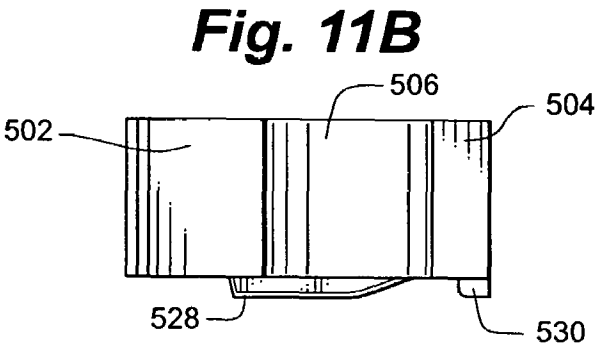
FIG. 11B is a side view.
Figure 11D:
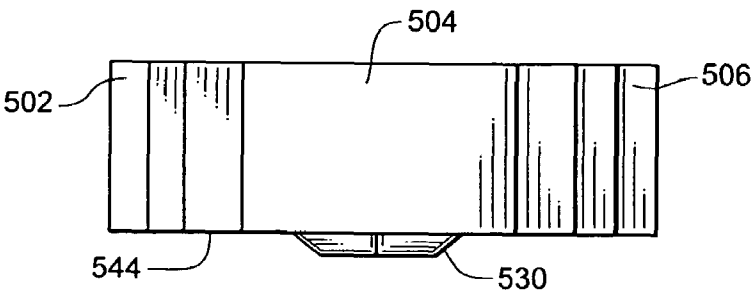
FIG. 11D is a rear view of a retaining wall block according to an embodiment of the present invention.
Figure 11A:
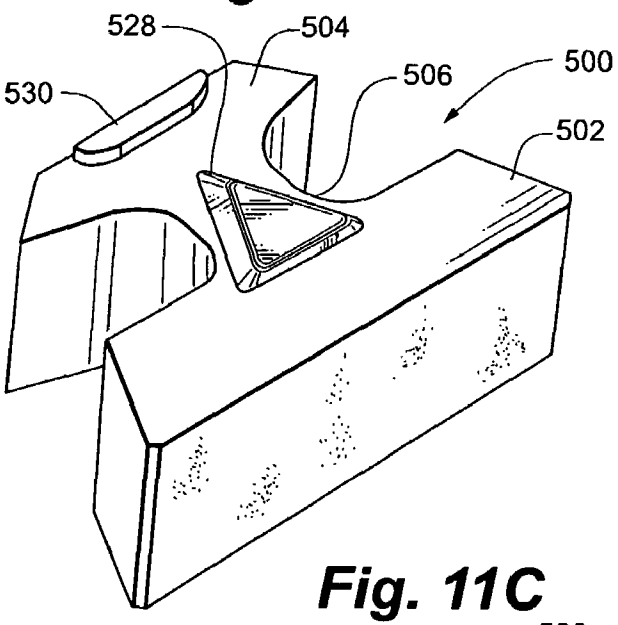
FIG. 11A is a bottom perspective view.
Figure 11C:
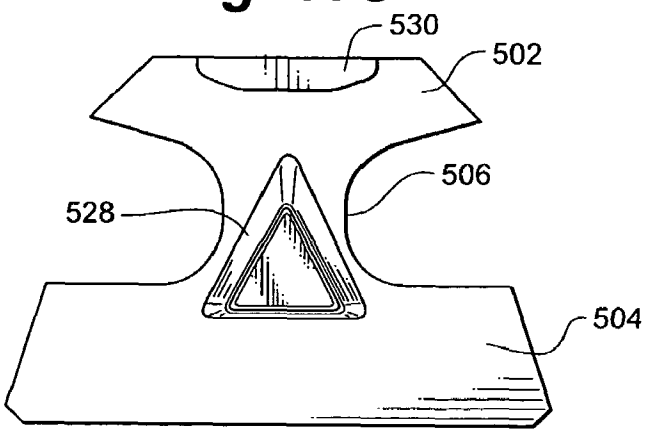
FIG. 11C is a bottom view.
Figure 12A:
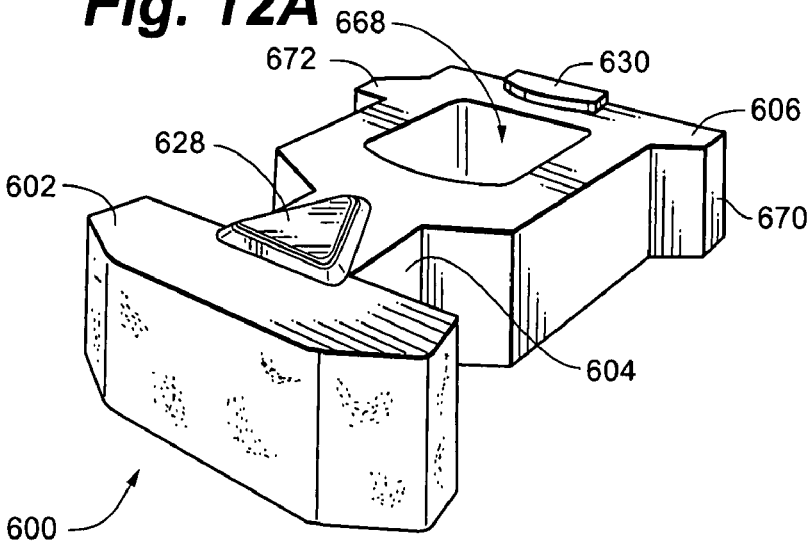
FIG. 12A is a bottom perspective view.
Figure 12B:
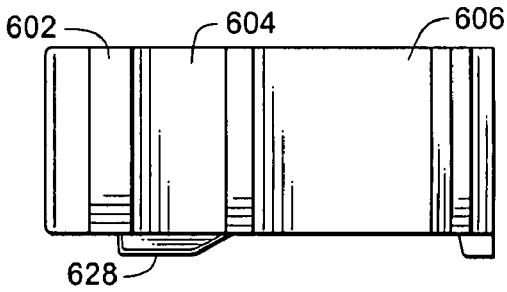
FIG. 12B is a side view.
Figure 12C:
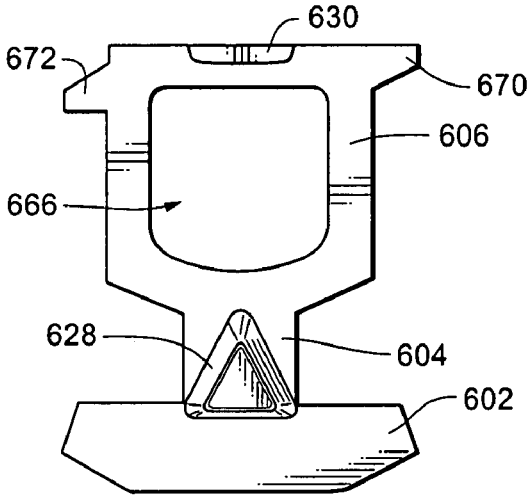
FIG. 12C is a bottom view.
Figure 12D:
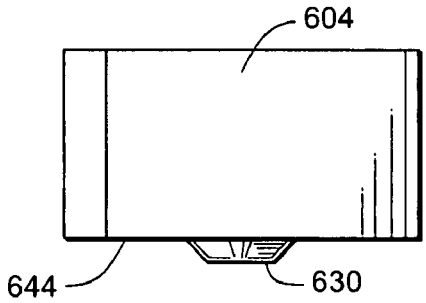
FIG. 12D is a rear view of a retaining wall block according to an embodiment of the present invention.

FIGS. 9A-9B depict a retaining wall block 300 according to another embodiment of the present invention. Block 300 comprises a front portion 302 and a rear portion 304 connected by a neck portion 306. Block 300 includes an interlocking projection 328 and a spacing projection 330 extending outwardly from a bottom surface 344 of block 300. Interlocking projection 328 and spacing projection 330 serve to interlock adjacent courses of blocks. Block 300 further includes a recessed portion 364 adjacent interlocking projection 328. Recessed portion 364, along with a smaller interlocking projection 328 and spacing projection 330, decreases the weight of the block 300 which makes blocks easier to transport and manipulate. Recessed portion 364 also provides additional clearance between courses of blocks. Further, recessed portion 364 allows blocks 300 to be stacked in either a columnar or running bond fashion.

A retaining wall block 400 according to another embodiment of the present invention is shown in FIGS. 10A-10D. Block 400 comprises a front portion 402 and a rear portion 404 connected by a neck portion 406. Block 400 includes a projection 428 extending outwardly from a bottom surface 444 of the block 400. This single projection 428 serves the functions provided by both the interlocking projection and the spacing projection of the above described blocks. Unitary projection 428 also provides a stronger and more chip resistant projection. In addition, block 400 is provided with a splitting groove 467 located along the length of projection 428. Splitting groove 467 allows for blocks to be more easily split in half to form half blocks, the use of which is described above.

Referring now to FIGS. 11A-11D, there can be seen another retaining wall block 500 according to an embodiment of the present invention. Block 500 comprises a front portion 502 and a rear portion 504 connected by a neck portion 506. Block 500 includes an interlocking projection 528 and a spacing projection 530 extending outwardly from a bottom surface 544 of the block 500. Interlocking projection 528 and spacing projection 530 serve to interlock adjacent courses of blocks and spacing projection 530 further serves to facilitate palletizing. Interlocking projection 528 uses less material than, for example, interlocking projections 128 and 228, and therefore makes block 500 easier to transport and manipulate. Interlocking projection 528 is also easy to manufacture because a majority of its perimeter is angled. In addition, the angled sides of interlocking projection 528 permit tighter radius curves when walls are constructed from blocks 500 with the tail portions 504 removed.

FIGS. 12A-12D depict a retaining wall block 600 according to another embodiment of the present invention. Block 600 comprises a front portion 602 and a rear portion 606 connected by a neck portion 604. An interlocking projection 628 and a spacing projection 630 similar to interlocking projection 528 and spacing projection 530 extend outwardly from a bottom surface 644 of the block 600. Block 600 further includes a core 668 through rear portion 606 which decreases the weight of the block and can be filled with a fill material to strengthen a wall of such blocks as is known in the art. Further, ears 670, 672 projecting outwardly from rear portion allow a wall of such blocks to have a substantially closed rear surface so that fill material contained therein cannot move outwardly. Block 600 is also a larger and longer block than the previously disclosed embodiments, which allows for higher walls to be more easily constructed in demanding situations.

The present invention has been described with reference to preferred embodiments. However, particular features of each of the exemplary embodiments may be mixed and matched with the features of any other embodiment, depending on the demands of the particular situation in which the block is to be used, without departing from the spirit and scope of the invention.

What is claimed is:

1. A preformed concrete block for use in a retaining wall comprising:

a front portion and a rear portion connected by a neck, the neck extending from a rear side of the front portion defining a pair of rearwardly facing surfaces on the front portion, the block presenting a top surface and a bottom surface, the front portion defining a notch in each of the pair of rearwardly facing surfaces, each notch extending from the bottom surface and presenting a depth dimension relative to the bottom surface and a width dimension extending laterally along the front portion towards the neck portion, wherein the width dimension is greater than the depth dimension, the block further including a projection extending outwardly from the bottom surface, the projection presenting a height dimension relative to the bottom. surface, wherein the depth dimension of each notch is greater than or equal to the height dimension of the projection.

2. The block of claim 1, wherein the projection is located between the notch in each of the pair of rearwardly facing surfaces.

3. The block of claim 1, further comprising a spacing portion extending outwardly from the bottom surface.

4. The block of claim 3, wherein the spacing portion comprises a tapered neck portion spanning the projection and the spacing portion.

5. The block of claim 1, wherein the projection comprises a front surface that is oriented generally perpendicular to the block bottom surface.

6. The block of claim 1, wherein the projection is generally square.

7. The block of claim 1, wherein the projection is generally rectangular.

8. The block of claim 1, wherein the projection is generally triangular.

9. The block of claim 1, wherein the front portion is wider than the rear portion.

10. The block of claim 1, wherein the projection extends from the neck portion.

11. The block of claim 1, further comprising a recess defined in the neck portion, the recessed portion extending from the bottom surface and presenting a depth dimension relative to the bottom surface.

12. A stackable block for use in forming a retaining wall, the block comprising:

a front portion;

a rear portion, the rear portion being narrower than the front portion;

a neck portion connecting the front portion and rear portion, the neck portion being narrower than the rear portion;

first and second notches defined inwards in the front portion, each notch extending from the bottom surface and presenting a depth dimension relative to the bottom surface and a width dimension extending laterally along the front portion towards the neck portion, wherein the width dimension is greater than the depth dimension; and a projection extending outwardly from the block and located between the first and second notches.

13. The block of claim 12, further comprising a splitting groove defined in the projection.

14. The block of claim 12, further comprising a slot configured to receive horizontal reinforcement defined in the projection.

* * * * *